United States Patent [19]

Onoe et al.

[11] 4,017,004

[45] Apr. 12, 1977

[54] PAPER MONEY DISPENSING APPARATUS

[75] Inventors: Katsuhiko Onoe; Masahiro Abe; Masashi Tamura, all of Himeji, Japan

[73] Assignee: Glory Kogyo Kabushiki Kaisha, Hyogo, Japan

[22] Filed: Feb. 19, 1975

[21] Appl. No.: 550,910

[30] Foreign Application Priority Data

Feb. 22, 1974 Japan ..... 49-20417
July 3, 1974 Japan ..... 49-76002

[52] U.S. Cl. ..... 221/94; 221/126; 221/192; 221/211; 221/236; 221/241; 271/9; 271/212; 194/DIG. 26

[51] Int. Cl.[2] ..... B65H 3/44

[58] Field of Search ..... 221/92, 126–127, 221/129, 211, 192, 130, 236, 241, 94; 194/DIG. 26; 271/9, 212

[56] References Cited

UNITED STATES PATENTS

| | | | |
|---|---|---|---|
| 2,988,236 | 6/1961 | Shields | 271/212 X |
| 3,168,644 | 2/1965 | Richardson et al. | 194/DIG. 26 |
| 3,191,927 | 6/1965 | Hartbauer et al. | 214/6 D X |
| 3,193,138 | 7/1965 | Cox et al. | 221/192 X |
| 3,532,230 | 10/1970 | Gutberlet et al. | 214/6.5 X |
| 3,601,265 | 8/1971 | Shields | 271/212 X |
| 3,760,158 | 9/1973 | Whitehead | 194/DIG. 26 |

FOREIGN PATENTS OR APPLICATIONS

| | | | |
|---|---|---|---|
| 1,213,489 | 11/1970 | United Kingdom | 271/9 |

*Primary Examiner*—Robert B. Reeves
*Assistant Examiner*—Charles A. Marmor
*Attorney, Agent, or Firm*—Wenderoth, Lind & Ponack

[57] ABSTRACT

Paper money such as bank notes of various denominations are dispensed by an apparatus having bank note storing cases including spaces which are adapted to store in a packed state sheets of the bank notes classified in accordance with the denominations, a note removal device provided at the note delivering end of each space in the note storing cases for taking the notes out of the note storing cases, and a note lifting device adapted to be selectively positioned in alignment with the note removal device for receiving the notes taken out by the note removal device. Preferably, each note removal device has a suction head and note removal rollers, and the note lifting device is a note kick-up roller, a stop member for dressing the leading edges of the notes, and a cam for regulating the position of the stop member in accordance with the width of the notes of the pertinent denomination.

2 Claims, 11 Drawing Figures

PAPER MONEY DISPENSING APPARATUS

BACKGROUND OF THE INVENTION

This invention relates generally to paper money dispensing devices, and more particularly to a type thereof wherein paper money such as bank notes (hereinafter referred to as notes) of various denominations stored in accordance with their denominations are delivered in a manner such that the amounts of the notes thus delivered are exactly equal to these specified by delivery instruction for each of the denominations.

Known in the art are not dispensing apparatuses wherein the notes are stored in a plurality of boxes, each assigned for a specific denomination of the notes, in a manner such that the notes are stacked vertically or packed together horizontally with the longitudinal edges thereof resting on the box, whereby a required amount of notes in desired denominations can be successively taken out of these boxes into a commonly provided note receiving device.

However, the lengths and widths of the notes may differ for different denominations, and furthermore, when the notes to be taken out of these boxes have lost stiffness and have acquired folding lines or wrinkles as in the case of old notes which have been in circulation, the operation of taking the notes out of the boxes cannot be carried out smoothly.

For facilitating the taking of the notes of the boxes, the note receiving mechanism must be placed exactly at a predetermined position relative to the notes in the boxes. The realization of such a condition has been found to be difficult in the conventional note dispensing apparatuses because both the money storing boxes and the money receiving mechanism are movable. Even in the cases where the positioning of the note receiving mechanism does not constitute any problem at an early part of the working period, the alignment between the note receiving mechanism and the box tends to deteriorate with the use of the apparatus, for instance, over several months or years.

Furthermore, the note receiving mechanism in the conventional note dispensing apparatuses has been so constructed that the notes taken out of the money storing boxes are stacked therein by gravity, and therefore there are encountered other difficulties such as the delivery of the notes from the mechanism to a note dispensing section not being smooth when the notes thus received have folding lines or wrinkles as described hereinbefore.

In the conventional money dispensing apparatus, there has been a provision for counting the notes each time a note is taken out of a money storing box, but if two sheets of notes are simultaneously taken out of the box during the money taking-out operation, an error will be introduced into the counted result. For preventing this error, there have been provided various means such as a gap gate through which only one sheet can pass and a sucking head with vacuum which abuts against a foremost note in the stack or pack in the money storing box and delivers the thus sucked note with the aid of a roller.

In the case where a gap gate is provided, the facility with which a note passes through the gap gate differs depending on the condition of the note. For this reason, the gap of the gate must be readjusted in accordance with whether the note is new or old. Furthermore, there is a tendency of the gap to be clogged by the notes or the like. In the case where a sucking head is used as described above, there still exists a possibility of the subsequent note in the stack also eing sucked by the sucking head as a result of the vacuum acting through the fibrous tissue of the foremost note. In addition, there has been a tendency of the second note to be pulled out together with the first note due to friction between adjacent notes.

SUMMARY OF THE INVENTION

With the above described difficulties in view, a primary object of the present invention is to provide a note dispensing apparatus wherein the notes stored in the note-storing boxes in accordance with the denominations can be taken out of the boxes in accordance with a required amount, and the possibility of erroneous delivery of the notes because of the misalignment between the note receiving mechanism and the note storing boxes can be substantially eliminated.

Another object of the invention is to provide a note dispensing apparatus wherein notes of all denominations can be stably dispensed regardless of their different lengths and widths.

Still another object of the inventon is to provide a note dispensing apparatus wherein the notes can be taken out of the boxes accurately one note at a time, and any error in counting the notes or in dispensing the notes can be thereby prevented.

These and other objects of the inventon which will be hereinafter made apparent can be achieved by a bank note dispensing apparatus comprising bank note storing means having note delivering ends and adapted to store in a packed state sheets of the bank notes classified in accordance with their denominations, means provided at the note delivering ends of the note storing means for taking the notes out of the note storing means, and note receiving means which can be moved to any of a plurality of positions of alignment with the note taking-out means for receiving the notes thus taken out by the note taking-out means.

Preferably, each of the note taking-out means provided at the note delivering end of each of the note storing means comprises at least a suction head which sucks a sheet of the bank note at the foremost position in the note storing means and separates the sheet from the succeeding sheets of the notes and note taking-out rollers which take out the note thus separated by the sucking head.

Preferably, the note receiving means comprises a rotatable supporting member which is rotated in a direction for receiving the notes into the note receiving means thereby to hold the trailing edge of the bank note, a stop member provided at a position spaced a predetermined distance from the rotatable support member for dressing or aligning the leading edges of the bank notes, means for urging the bank notes toward the stop member, and means for regulating the position of the stop member in accordance with the width of the bank notes received in the note receiving means.

The nature, principle, and utility of the invention will be more clearly understood from the following detailed description of the invention, with respect to a preferred embodiment, thereof, when read in conjunction with the accompanying drawings.

DETAILED DESCRIPTION

A preferred embodiment of the invention will now be described by way of example with reference to the accompanying drawings.

A. General Features

Figure 1:
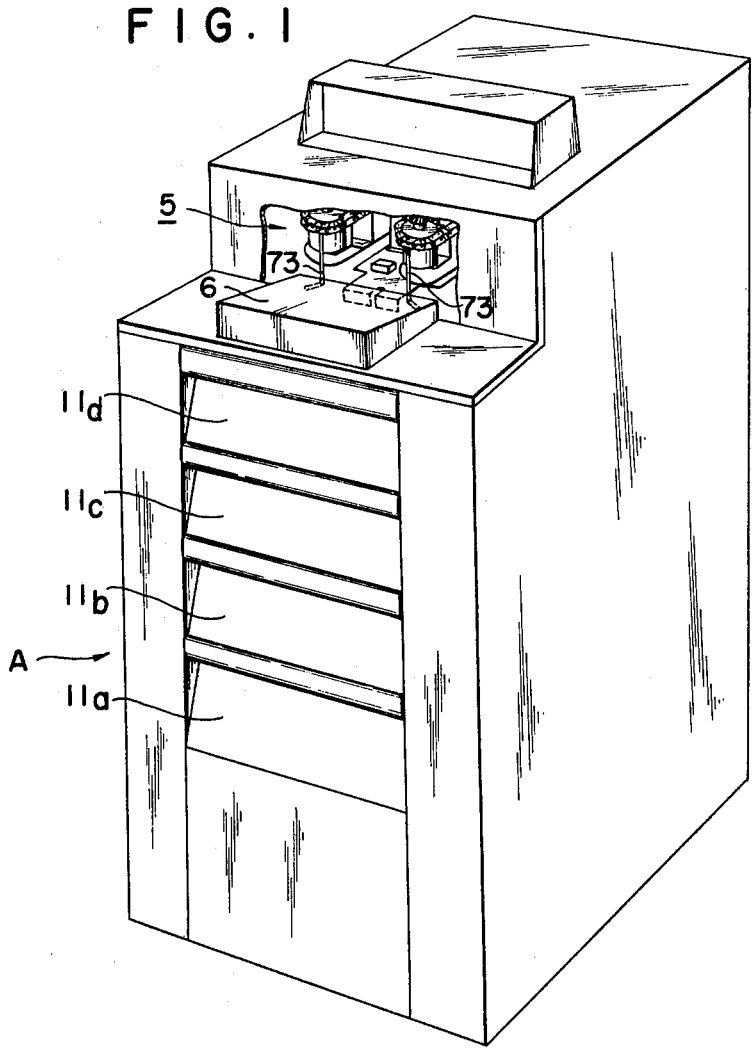
FIG. 1 is a perspective view showing the exterior of an example of a bank note dispensing apparatus constituting a preferred embodiment of the present invention.

The embodiment of the invention shown in the drawings shows an example in which the invention is applied to a bank note dispensing apparatus. In this example, referring to FIGS. 1 and 2, the bank note dispensing apparartus comprises a base 1, a note storing section 2 disposed above and on one side of the base 1 and having the function of storing in a packed state sheets of bank notes which are classified in groups according to the denominations thereof, a note take-out device 3 adapted to strip off sheet by sheet bank notes from the packed notes in the storing section 2 and delivering the stripped-off sheets of bank notes, a lift device 4 adapted to move vertically and stop in a positon confronting the take-out side of each note storing section 2 for taking-out bank notes of the corresponding denomination and stacking the bank notes for momentary storage, a note conveying device 5 disposed in a position above the note storing section 2 and adapted to convey in a pushing manner the notes stacked on the lift device 4 toward the front side A (hereinafter defined as "front" or"forward" and from which the bank notes are charged or in which direction the classified bank notes are delivered for dispensing, the term "rear" or "rearward" being used with respect to the opposite side or direction) or the side for charging the notes of the above mentioned storing section 2, and a note dispensing section 6 for receiving the notes pushed by the conveying device 5 so as to make the notes ready for dispensing to an operator of the apparatus.

B. Construction

I. Note Storing Section 2

The above mentioned note storing section 2 includes, for instance, four shelves for receiving in position four note storing cases 11*a*, 11*b*, 11*c*, 11*d* which are adapted to store in a packed state sheets of bank notes classified in groups according to the denominations thereof, i.e., 10,000 yen notes, 5,000 yen notes, 1,000 yen notes, and 500 yen notes, respectively, between side panel boards 10, which are erected parallel to each other upon the base 1. Each of the storing cases 11*a* through 11*d* is installed with a substantially downward gradient toward and with respect to the note take-out device 3 and can be drawn outwardly from the above mentioned shelves in the front side A so that the bank notes may be stored in a the interior thereof in packed state and urged rearwardly under the force of gravity or resilient means.

II. Note Take-out Device 3

Figure 3:
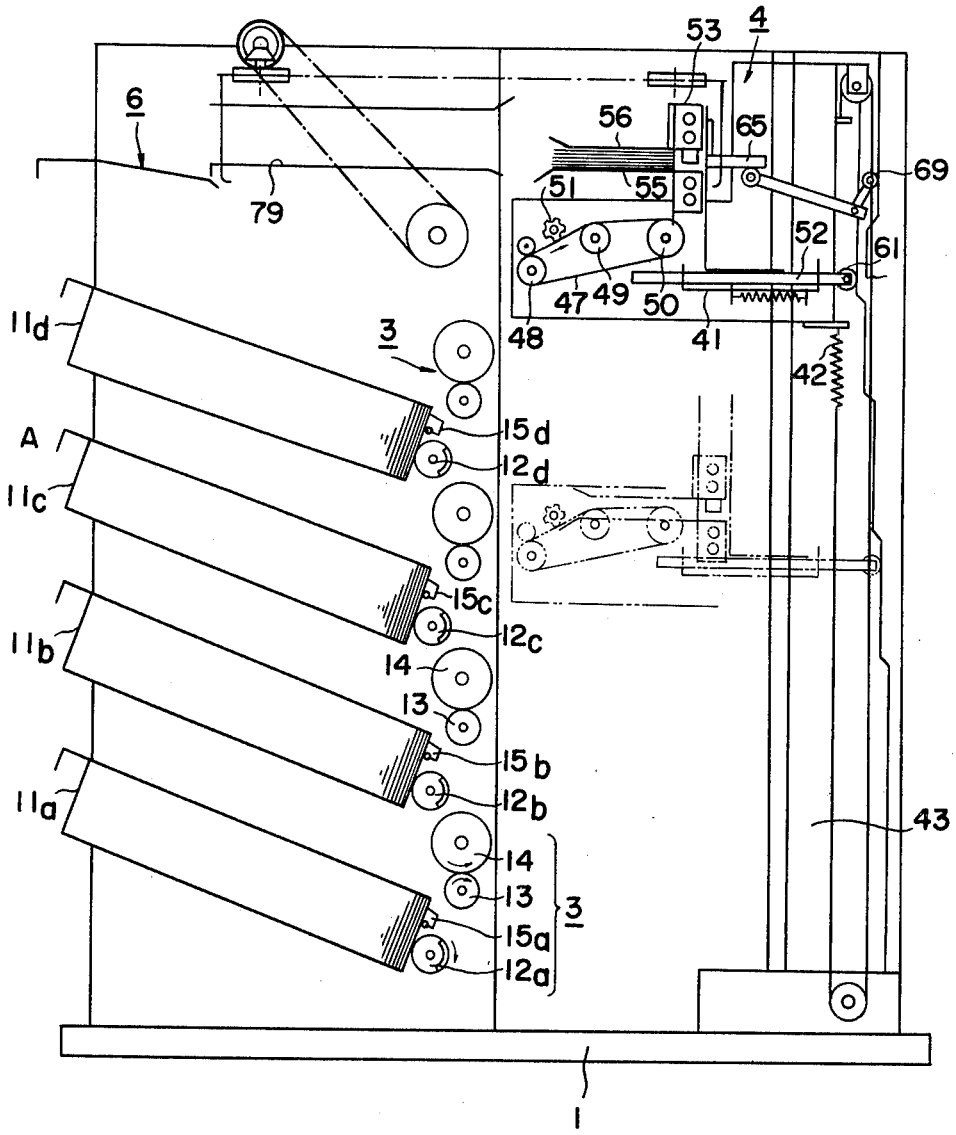
FIG. 3 is a side elevation indicating the operation of important parts of the apparatus.

Referring now to FIG. 3, the above mentioned note take-out devices 3 are all of exactly the same construction, i.e., each comprising a note take-out roller 12*a* (12*b*, 12*c*, or 12*d*) disposed at the end opposite the above mentioned front side A of a respective note storing case 11*a* (11*b*, 11*c*, or 11*d*) so as to face the end, which storing case is slidably positioned on a respective shelf, a pair of delivery rollers 13, 14 disposed above each note take-out roller and adapted to deliver upwardly a note which has been taken out of a case, and a suction head 15*a* (15*b*, 15*c*, or 15*d*) disposed between the pair of delivery rollers 13, 14 and the take-out roller and adapted to separate one note from the packed notes by vacuum. In this construction, the above mentioned pair of delivery rollers 13, 14 are constantly driven in a direction as indicated by the arrows in FIG. 3.

The note take-out devices 3 will now be described in greater detail with reference to FIG. 4. Each of the note take-out rollers 12 (now benerally referred to) may comprise one or more roller elements mounted coaxialy on a shaft 16, e.g., four roller elements as in the example shown in FIG. 4. Likewise, the pair of delivery rollers 13, 14 may comprise one or more roller elements, as in the example of FIG. 4, the axial positions corresponding to those of the above mentioned note take-out rollers, and the suction head 15 (now generally referred to) may comprise one head element or a plurality of head elements, e.g., three elements as in the example illustrated in FIG. 4.

The shafts 16 of the note take-out rollers 12*a*, 12*b*, 12*c* and 12*d* at their ends extending outwardly from one side panel board 10 are provided with driven friction rollers 17*a*, 17*b*, 17*c*, and 17*d*, respectively.

Adjacent each of the above mentioned driven friction rollers 17*a* 18*c*, or 18*d* 17*b*, 17*c* and 17*d*, there is provided an oscillatory lever 18*a*, 18*b*, 18*c*,or 18*d*, respectively, which lever at its middle part is installed pivotally about a fulcrum 0 and is provided with a driving friction roller 19*a*,19*b*, 19*c*, or 19*d* at one end thereof, which is adapted to be moved toward and away from the above mentioned driven friction roller 17*a*, 17*b*, 17*c*, or 17*d* corresponding thereto. At the opposite end of the oscillatory lever 18*a*, 18*b*, 18*c*, or 18*d* is connected a solenoid plunger 21*a*, 21*b*, or 21*c*, or 21*d* of a respective solenoid assembly 20*a*, 20*b*, 20*c*, or 20*d*. By the reciprocating motion of a solenoid plunger 21, the corresponding lever 18 is caused to be pivotally rotated about the fulcrum so that the corresponding driving and driven friction rollers 17 and 19 engage each other in a frictional power transmission state.

Pulleys 22*a*, 22*b*, 22*c*, and 22*d* are provided adjacent and coaxially with the driving friction rollers 19*a*, 19*b*, 19*c*, and 19*d*, respectively, and all of these pulleys are driven in rotation at the same speed and in the same direction of rotation by the output shaft 23 of an electric motor $M_1$ through a reduction gear mechanism 24, a driving belt 25, pulleys 26*a*, 26*b*, 26*c*, and 26*d*, and belts 27*a*, 27*b*, 27*c*, and 27*d*. The belts 27*a*, 27*b*, 27*c*, ad 27*d* passed around the pulleys 26*a* through 26*d* and 22*a* through 22*d*, respectively, are preferably made of synthetic rubber or the like having an appropriate stretchability.

Figure 4:
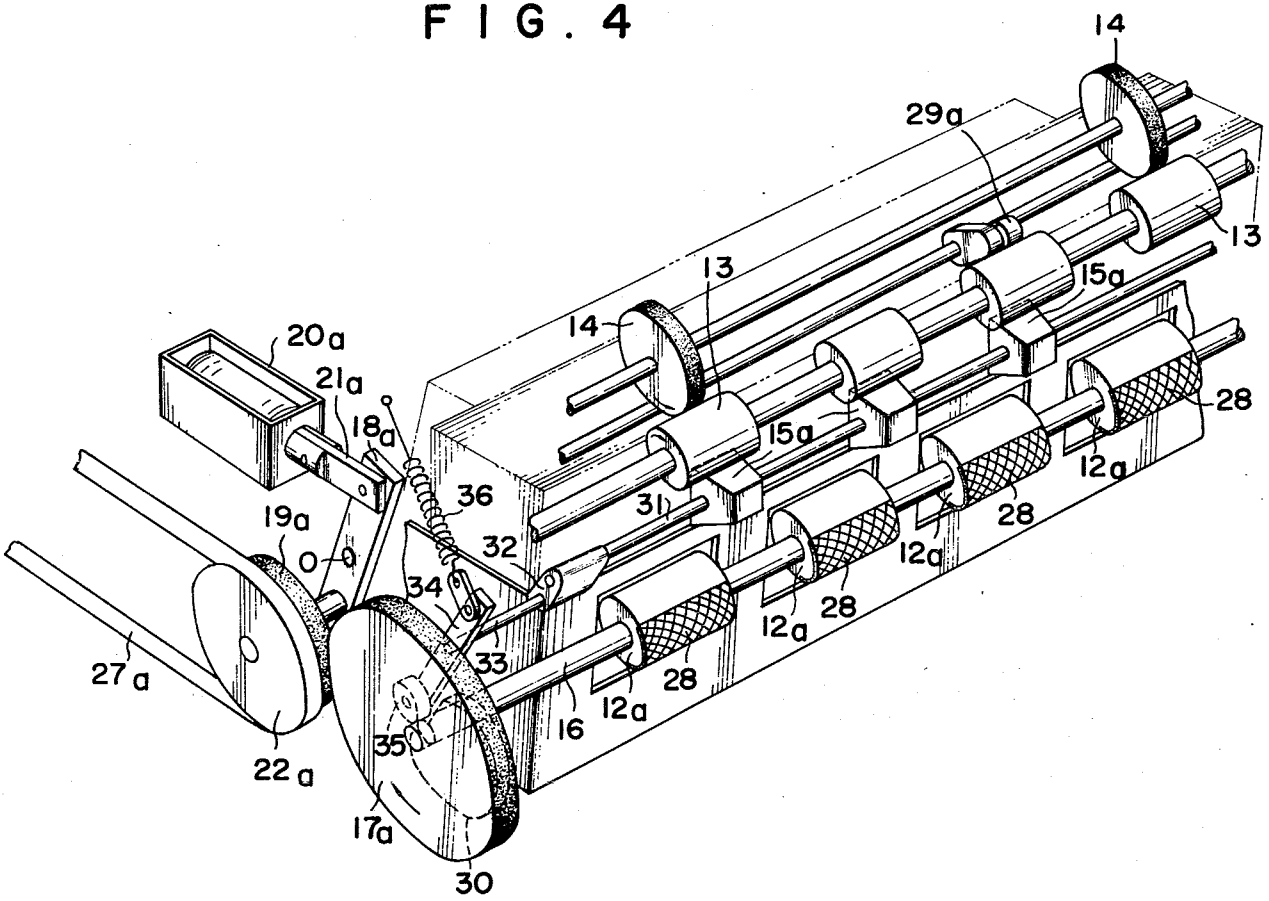
FIG. 4 is a perspective view, on much enlarged scale, of one part of a note taking-out device constituting an important part of the invention.

The above mentioned note take-out rollers 12*a*, 12*b*, 12*c*, or 12*d* are, as best shown in FIG. 4, disposed in a position to abut against the front face of a bank note at the head of the packed notes at the center and both sides thereof. Each roller 12 is provided with a stirp-off land 28 substantially raised radially outwardly from the circumferential surface of the roller 12 and extending partially circumferentially and over the entire width of the roller. The strip-off portion 28 is formed of a frictional material such as rubber or the like.

There is further provided counting rollers 29*a*, 29*b*, 29*c*, and 29*d*, (this last two not being shown) which are pivotally supported to follow the surface of a bank note being taken out and passing through between the counting roller and a corresponding delivery roller so as to count the number of notes passing therethrough.

Figure 5:
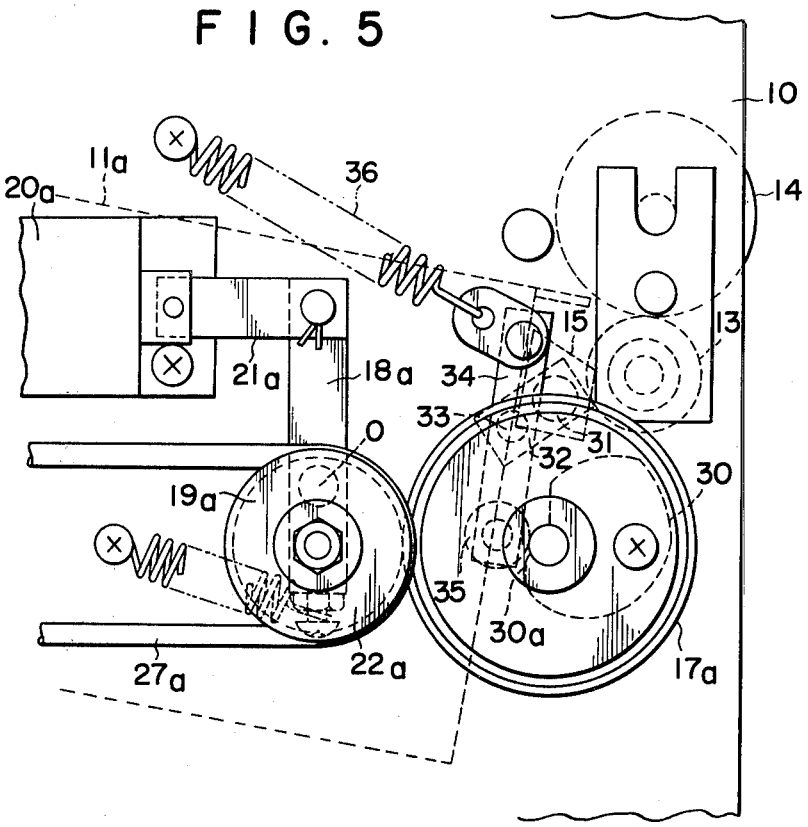
FIG. 5 is a fragmentary side elevation of the note taking-out device shown in FIG. 4.
Figure 6:
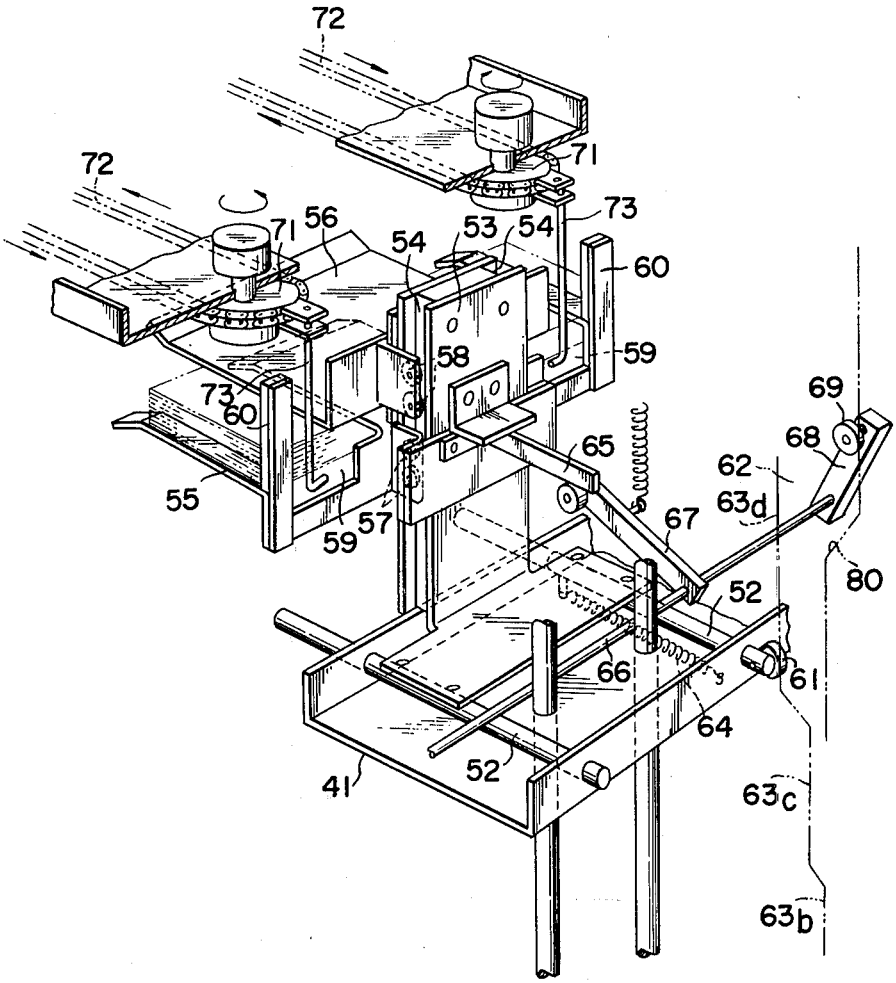
FIG. 6 is a fragmentary perspective view of a note receiving lift device constituting another important part of this invention.

A cam 30 is provided behind each driven friction roller 17*a*, 17*b*, 17*c*, and 17*d*, as shown by a phantom line in FIGS. 4 and 5. This cam 30 has a profile which causes the above mention corresponding suction head 15*a*, 15*b*, 15*c*, or 15*d*, (hereinafter designated generally by reference numeral 15) to be actuated as later described further and also causes the corresponding note take-out roller 12 to assume the starting position thereof.

The operation and function of the cam 30 are as follows. There is provided a lever 34 having as a fulcrum a shaft 33 of a crank member 32 fixed to the end of a conduit 31 on which the suction heads 15 are mounted, the lever 34 having a cam follower roller 35 at the one end thereof, the roller 35 being caused to press constantly against the circumferential surface of the cam 30 under the urging force of a spring 36 adapted to pull the opposite end of the lever 34, whereby when the roller 35 rests at a recessed portion 30*a* of the cam 30, the operating plane of the suction head 15 takes a position in abutment with the surface of a bank note at the head. In this state, the leading edge of the strip-off portion 28 on the note take-out roller 12 initiates contact with the foremost or first note, after the suction head 15 functions to separate by its suction that note from the packed other sheets.

III. Lift Device 4

Figure 2:
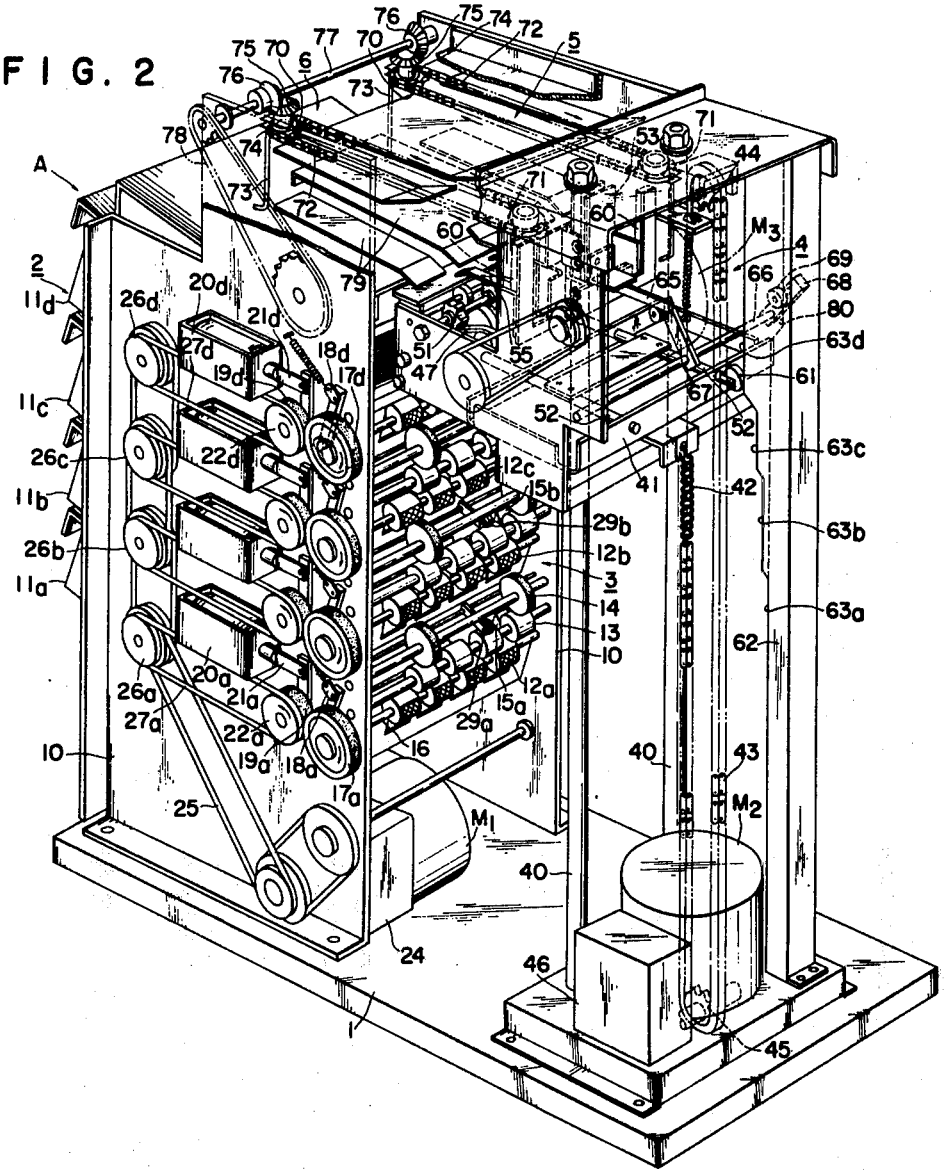
FIG. 2 is a perspective view, with outer panels removed and parts cut away, showing the internal construction and arrangement of the apparatus shown in FIG. 1.

Referring to FIGS. 2 an 3, the lift devce 4 comprises generally a frame 41 which is capable of moving vertically and is guided by and along posts 40 which are erected upright from the base 1, the frame 41 being suspended by way of a chain 43, which is directly connected to the upper portion of the frame 41 and passed around upper and lower sprockets 44, 45 through a spring 42 connected to the trailing end thereof, so that the frame 41 can be moved vertically to a desired lifted position, the lower sprocket 45 being driven by an electric $M_2$ through a reduction gear mechanism 46.

In the above mentioned frame 41, there are provided a plurality of note conveying belts 47 having front ends adapted to confront the delivery rollers 13, 14 of the above mentioned note take-out device 3 and passed around pulleys 48, 49, 50, the plurality of belts being driven in the direction as indicated by an arrow in FIG. 3 by an electric motor $M_3$ and through pulleys and a belt (not designated), and the right-hand span of the belt 47 between the pulleys 49 and 50 as viewed in FIG. 3 being arranged to be generally horizontal. A kick-up roller 51 haivng a plurality of axially extending recesses in disposed above the note conveying belts 47 in contacting engagement relationship between the pulleys 48 and 49 so that the kick-up roller 51 can be driven in rotation by the belts 47. Such arrangement of the roller 51 is for the purpose of repeatedly kicking upwardly the trailing edge of a note conveyed by and on the belts 47 so that entrance of a following note will be facilitated and promoted.

Furthermore, in the above mentioned frame construction, there are provided two sliding rods 52 which are arranged to be slidable toward the note take-out device 3, and there is erected a guide structure 53 upon the sliding rods 52 having two guide grooves 54 formed on both sides thereof so that guide rollers 57, 58 mounted respectively at the foot ends of a note receiving panel 55 and a complementary note holding panel 56 may engage in rotatable relationship with the grooves 54, and so permit the note receiving panel and the note holding panel to be movable vertically and independently of each other.

The above mentioned note receiving panel 55 is designed with a front-to-back dimension to efficiently accommodate the width of a bank note of largest denomination or of the largest size, i.e., 10,000 yen note in this example, and has lengthwise cutouts 59 extending along the path of note pushing pins of the note conveying device 5 (to be described later in detail) and permitting entrance of the note conveying belts 47. There are also erected two stop members 60 upright with respect to the note receiving panel 55 for the purpose of aligning laterally the entering lead edges of the bank notes. The note holding panel 56 is signal panel having an area to efficiently hold in a pressing manner the notes placed on the surface of the note receiving panel 55.

At the leading end of one of the sliding rods 52, there is provided a roller 61 which moves along a path in a vertical direction so that the roller will engage under the urging force of a spring 64 with the surfaces in cams 63*a*, 63*b*, 63*c*, and 63*d* of stepped profile extending vertically along a frame post 62 of the note dispensing apparatus, the stepped configuration of the cam surface corresponding to the bank notes of different width in the following manner.

The stepped cam surfaces have a profile such that the distance from a rear part on the circumference of the kick-up roller 51 facing the stop members to the front place of the above mentioned stop members 60 coincides with the different widths of the bank notes which are stacked against the front panel of the stop members 60 where the lift device 4 stops in the predetermined elevated positions so as to receive the notes from the conveying belts 47, whereby the difference of the widths of the bank notes according to the denominations thereof may be compenssated for properly with the entering edges of the notes aligned against the front plane of the stop members 60. In this illustrated example, the width of a 10,000 yen note is used as a reference for the above mentioned alignment purpose.

In this respect, the first stepped cam surface has a dimension such that it will cause the roller 61 or the front plane of the stop 60 to be positioned with respect to the kick-up roller 51 to the extent that the distance from the rear circumference of the kick-up roller 51 to the front plane of the stop member 60 will correspond to the width of the 10,000 yen notes stacked on the upper surface of the note receiving panel 55. The second stepped cam surface has such a dimension that it will cause the front plane of the stop 60 to be pushed forwardly to the extent that the distance from the kick-up roller 51 to the front plane of the stop member 60 will correspond to the width of the 5000 yen notes subsequently stacked on the 10,000 yen notes. Likewise, the third and fourth stepped cam surfaces are of such dimensions that they will cause the front plane of the stop member 60 to be pushed further forwardly to the extent that the distance from the kick-up roller 51 to the front plane of the stop 60 will correspond to the widths of the 1000 yen and 500 yen notes, respectively.

Behind the above mentioned note receiving panel 55, there is provided an arm 65 extending rearwardly from the guide structure 53 and engaging with an end of a lever 67 which is pivotally mounted on a rod 66 with respect to the frame 41 of the apparatus, and there is another lever 68 pivotally mounted on the rod 66, a roller 69 disposed at an end of the lever 68 being arranged to rotatably abut against another cam 80 formed in the side of the above mentioned frame post 62.

IV. Note Conveying Device 5

The note conveying device 5 comprises a pair of endless chains 72 for conveying a stack of notes and extending respectively around a pair of driving sprocket wheels 70 and a pair of driven sprocket wheels 71 in such a manner that these chains will be moved in a horizontal plane and in running directions opposite to each other, the pair of chains 72 having a pair of note delivery pins 73 suspended therefrom in symmetrical relationship, respectively.

A pair of bevel gears 75 are provided on shafts 74 of the sprocket wheels 70 and another pair of bevel gears are provided 76 on a shaft 77, which are adapted to complementarily engage in the pair of bevel gears 75, the shaft 77 being driven by the motor $M_1$ or another motor (not shown) through a chain 78 and a clutch mechanism,thus driving the chains 72 for conveying a stack of notes.

The above mentioned pair of note conveying pins 73 are synchronously driven by the pair of chains 72, respectively, in a locus which defines an oblong path extending from the exterior sides of the chains 72 into and along the cutouts 59 defined in the note receiving panel 55, the lower ends of the pins being bent toward the direction of run thereof. A note guide panel 79 is provided along the above mentioned locus of the not conveying pins in a manner to permit passing of the note conveying pins 73.

Adjacent the delivery path of the above mentioned note conveying device 5, there is provided a note dispensing section 6 adapted to operatively receive the stacked bank notes delivered by the note conveying pins 73 and make ready for dispensing the bank notes to the operator. This note dispensing section 6 opens to face the front side A for charging the above mentioned note storing section 2 with the bank notes so as to dispense the notes.

Figure 7:
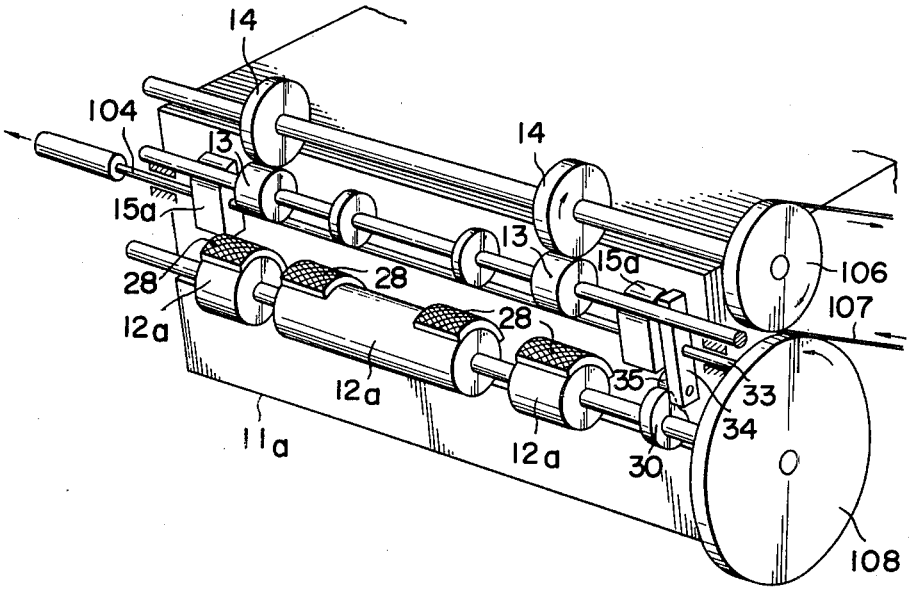
FIG. 7 is a perspective view of a modification of the note taking-out device of this invention.
Figure 9:
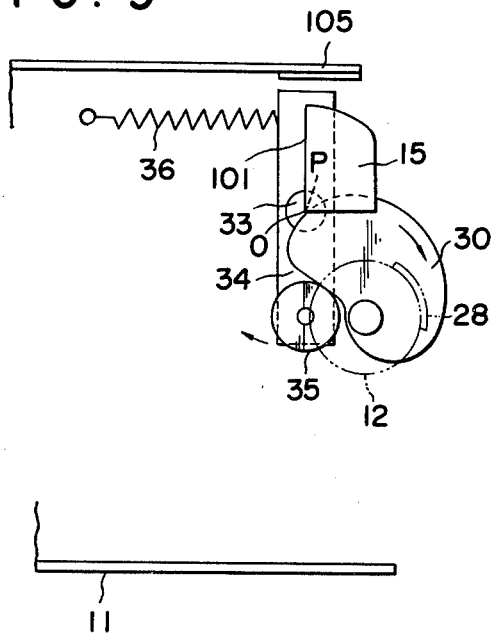
FIG. 9 is an explanatory diagram showing a suction head swinging mechanism constituting one part of the note taking-out devie of this invention.
Figure 8:
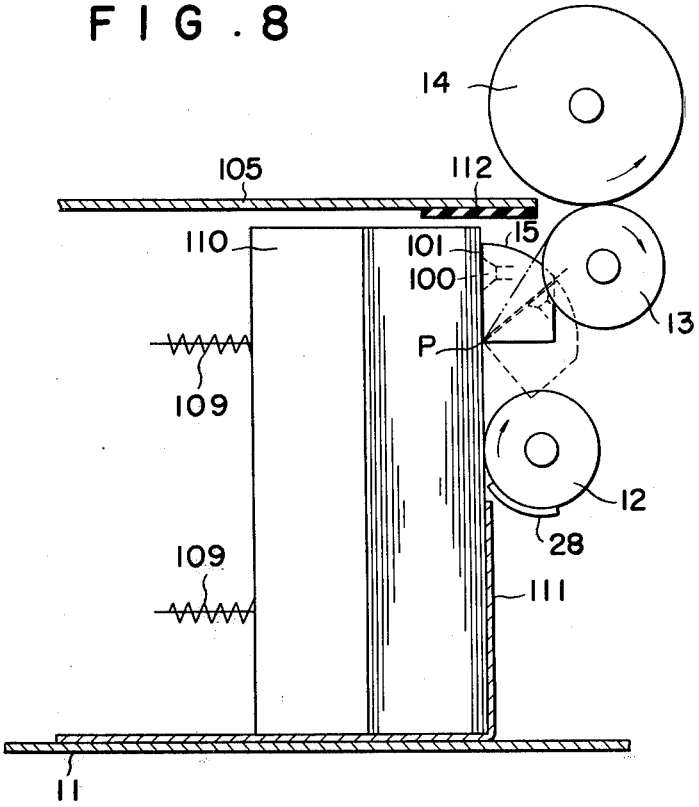
FIG. 8 is a side elevation , partly in section of the modification shown in FIG. 7.

Referring not to FIGS. 7, 8, and 9, the suction heads 15 and the members relating thereto will now be further described.

As best shown in FIG. 8, each suction head 15 is provided with a sucking port 100 for exerting suction by vacuum in the plane or surface facing the note surface and has a lower corner p which is a straight edge in the sucking surface 101, which is pivotally held by the rod 33 about the point P where the suction head 15 contacts edgewise with the surface of the first of the notes stored in a packed state in the storing case 11. More specifically, the above mentioned suction head 15 is secured at the free end of the lever 34 mounted on the rod 33, as best seen in FIG. 7, in such a manner that the axis 0 of the rod 33 and the lower edge P of the sucking port surface 101 of the suction head 15 are aligned on the same line so that the lower edge P does not deviate or is not displaced from the note surface when the rod 33 is rotated.

The above mentioned suction head 15 is connected to a vacuum source (a vacuum pump, not shown) through a common conduit 104, in which suction head 15 the conduit 104 communicates with the above mentioned sucking port 100. Therefore, when a bank note is sucked out from the packed notes, a suction force is produced under control by means of a valve or the like (not shown), in the sucking port 100 during the period when the sucking surface 101 sucks out the sheet of note and the leading edge of the sucked note comes to a position to be engaged between the delivery rollers 13, 14.

In the example shown in FIG. 8, the bank notes are stored in an upright packed state in the storing cases 11 and are urged against the retaining panel 111 disposed upright in the lower part of the note holder 110, which is under the biasing force of the springs 109. Cover plates 105 are also provided closely adjacent the upper edges of the packed notes and extending horizontally toward the note take-out devices 3 in the storing section 2. Each of the cover plates 105 is further provided with a pad 112 of rubber or the like on the lower surface thereof on the note taking-out side. This cover plate 105 functions, when a first note sucked by the above mentioned suction head 15 is drawn out, accompained by the adjacently succeeding sheet, to obstruct the upper end of this succeeding sheet thereby to prevent this sheet from being drawn out together with the first sheet.

A pulley 106 is provided on the shaft of the above mentioned delivery rollers 14 so as to receive rotational power through a belt 107 for rotating the rollers 14 in the direction as shown by arrows in FIGS. 7 and 8. A friction wheel 108 is mounted on the shaft of the above mentioned take-out rollers 12 so that the wheel 108 is driven by frictional contact with the belt 107. The transmission of rotation to the pulley 106 is so controlled by means such as a clutch or by stopping the motive power source that it will continue its rotation during the operation of taking-out the number of bank notes of the denomination as instructed, and will stop its rotation upon the receipt of a signal indicating completion of taking out of the applicable number of sheets.

C. Operation

The operation of the preferred embodiment of the invention having the above described organization is as follows.

As a first step, a plurality of bank notes classified according to denomination are loaded in packed state is the respective note storing cases 11*a*, 11*b*, 11*c*, and 11*d* in the note storing section 2, and thereafter the note storing cases are installed in their respective positions in the storing section, whereby a first of the notes positioned at the head of the packed notes is now caused to confront the note take-out device 3. In this step, as described hereinbefore, it is essential that the bank notes of the largest denomination or of the largest dimensions in width and length be stored in the lowest storing case, or the case 11*a*, in this example. In the storing case 11*b*, it is necessary to store the bank notes having the second largest dimensions, and the storing cases 11*c* and 11*d* are for storing the bank notes having the third largest dimensions and the smallest dimensions, respectively.

Then when an instruction for starting is transmitted, the motor $M_1$ starts operating to drive in rotation in the same direction as shown by arrows in FIG. 2 and at the same speed all pulleys 22*a*, 22*b*, 22*c*, and 22*d* and, thus, the driving friction rollers 19*a*, 19*b*, 19*c*, and 19*d* through the power train of the reduction gear mechanism 24, belt 25, pulleys 26*a*, 26*b*, 26*c*, and 26*d*, and belts 27*a*, 27*b*, 27*c*, and 27*d*.

At this moment, since the driving pulleys 22 (hereinafter referred only generally without any respective subscripts) are caused to be kept away or disengaged from the driven friction rollers 17 by the solenoid plungers 21 of the solenoid assemblies 20 in their protruded position, there is no transmission of rotation to the note take-out rollers 12.

For instance, when four thousand yen is required to be taken out, according to an instruction therefor from the control of the note dispensing apparatus (not shown), the lift device 4 is now caused to travel by the cooperative operation of the motor $M_2$, the reduction gear mechanism 46, and the chain 43 to and stop at the predetermined position opposing the note take-out device 3 of the storing case 11*c* in which 1,000 yen notes are stored in the packed state.

In this position, as the roller 61 at the rear end of the sliding rod 52 comes to a position abutting the surface of the cam 63*c*, thus causing forward travel of the sliding rod 52 or the stop member 6o a distance corresponding to the width of the 1,000 yen note, so that the distance from the front plane of the stop member 60 to the rear part of the kick-up roller 51 is made to correspond to the width of a one-thousand yen note.

Upon stopping of the above mentioned lift device 4 at the position facing the storing case 11*c* containing one-thousand yen notes, the solenoid assembly 20*c* adapted to take out one-thousand yen notes is now energized, whereby the solenoid plunger 21*c* is retracted inwardly so as to pivot the lever 18*c* about the fulcrum 0, thus urging the driving friction roller 19*c*, toward the driven roller 17*c* against the biasing force of a spring.

At this moment, the rotating motion of the driving roller 19*c* is transmitted to the driven roller 17*c*, and at the same time the suction head 15*c* is also caused to function to suck a first bank note off the packed notes. At the following instant, the cam follower 35 is pushed radially outwardly by the cam 30 on the axis of the above mentioned driven friction roller 17*c*, thereby causing the lever 34 or the suction head 15*c* to be rocked through the crank portion 32 and the rod 33 to move to a predetermined angular position, thus stripping the first note off the packed notes. In this case, since the distance between the conduit 31 and the lower corner of the front surface are designed to be equal, the suction head 15*c* is caused to move in a rocking motion with its lower corner point as a fulcrum, thus promoting the separation of the first note from the packed notes.

Now referring to FIGS. 7 and 9, the operation of the suction heads 15 and the members relating thereto will be further described.

When power for driving the device is transmitted through the belt 107, the pulley 106 and the friction pulley 108 are thereby rotated, thus rotating the take-out rollers 12*a*, rollers 13 driven by the delivery rollers 14, and the cam 30. The rotation of the cam 30 moves the cam follower 35 abutting thereagainst thereby causing the lever 34 to swing around the pivotal point O. Thus, the surface 101, having the sucking port 100, of the suction head 15 is brought into abutment with the first surface of the foremost note so that the latter is sucked onto the surface 101.

Thereafter, the suction head 15 is rotated in a clockwise direction around a pivotal point P located along a lower corner of the sucking surface 101, whereby the suction head 15 is rotated to a position indicated by the broken line in FIG.8 in accordance with the rotation of the cam 30, and the single note is thereby separated from the remaining notes. The vacuum at the suction port 100 is so adjusted that, during the separation ,the suction head 15 can suck only a single one of the notes placed directly in front of the sucking surface 101 of the suction head. Furthermore, the timing of releasing the vacuum is so adjusted that the upper part of the note thus sucked and separated abuts against the circumference of the driven roller 13, and by the release of the vacuum and the friction of the driven roller 13, the note is separated from the suction surface 101 of the suction head 15.

When the leading edges of the raised surface portions 28 of the take-out rollers 12*a* are thereafter brought into contact with the note thus separated from the suction head 15, the note is shifted upwards relative to the remaining notes by friction, and is received between the driving rollers 14 and the driven rollers 13.

If two notes are taken out simultaneously by the suction head 15, the second of the two notes abuts against the lower surface of the pad 112 on the cover plate 105, whereby the simultaneous delivery of the two sheets of the notes can be prevented.

The above described operation for taking out a single note from the note storing device is accomplished for every rotation of the note take-out rollers 12*a* and one reciprocation of the suction head 15, and when the rotation of the rollers 12*a* and the reciprocation of the suction head 15 are repeated, the notes in the note storing device can be taken out of the note storing device.

A bank note thus stripped off is now driven out toward and between the delivery rollers 13 and 14 and then further delivered thereby toward the lift device 4 until the note is duly pinched between the note conveying belt 47 and the pick-up roller 51 and is finally delivered into a position where the leading edge of the bank note abuts against the front plane of the stop members 60. As stated above, the trailing edge of the bank note thus delivered and stacked on the note receiving panel 55 is constantly kicked upwardly by the circumferential surface with recesses of the kick-up roller 51 the rear circumferential part of which is in continual contact relationship with the trailing edge of the note, thus positively preventing interference caused by the leading edge of the succeeding bank note successively delivered thereto and thus promoting the insertion of the following bank note between the above mentioned stacked note and the note receiving panel 55.

Thus, when four one-thousand yen notes are delivered into position on the note receiving panel 55, the solenoid assembly **20*c* is now deenergized by an instruction from the control of the apparatus, and the driving friction roller 19*c* is caused to disengage from the driving friction roller 17*c* by protrusion of the solenoid plunger 21*c*, thus stopping the transmission of the rotation to the driven friction roller 17*c*.**

At this moment, the operation of the note take-out roller **12*c* and the suction head 15*c* is now stopped, and the roller 35 contacting the cam 30 on the shaft of the driven friction roller 17*c* is urged to return to the least diameter portion 30*a* of the cam 30 by the biasing force of the spring 36, whereby the friction roller 17*c* is caused to rotate until the above mentioned roller 35 rests at the position 30*a* of the cam 30. Consequently, the suction head 15*c* is now in position with its sucking surface 101 resting in face-to-face relation with the first bank note stored in a packed state in the note storing case 11*c*, and the note take-out roller 12*c* stops with the leading edge of the strip-off land 28 thereof resting in a predetermined position midway from the surface of the first bank note in the storing case 11*c*.**

Upon completion of this operation, the lift device 4 carrying the above mentioned four one-thousand yen notes on the note conveying belts 47 thereof is now elevated to its highest position so predetermined (as shown in solid line in FIG. 3), and then the roller 69 is disposed on the lever 68 adapted to vertically move the note receiving panel 55 together with the holding panel 56 now descends to the recessed position of the cam 80 on the frame post 62, thus causing the note receiving panel 55 to be raised upwardly together with the note holding panel 56 holding the notes therebetween, by cooperative function of the levers 68 and 67 to the extent that the stack of bank notes are horizontally level with the note guide panel 79 of the note dispensing section 6. By this operation, the stack of bank notes is now held between the receiving panel 55 and holding panel 56 away from the note conveying belts 47.

At this moment, the note conveying device 5 starts its operation, i.e., note delivery pins 73 suspended therefrom come into the note pushing position, following the driving locus of the chain 72 from the exterior sides thereof and then enter into the cutouts 59 in the note receiving panel 55 from behind, thus, the note guide panel 79 in sliding manner, finally moving toward the predetermined position for dispensing the bank notes in the note dispensing section 6.

The pack of bank notes thus delivered to the dispensing section 6 is now ready to be picked up and handled by the operator of the note dispensing apparatus through the opening of the dispensing section facing the front side A thereof.

Figure 10A:
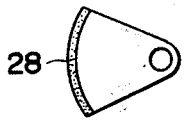
FIGS. 10(A) and (B) are side views showing other examples of the note taking-out roller in the note taking-out device constituting an important part of this invention.
Figure 10B:
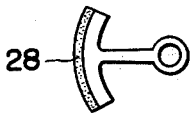

The note delivery rollers 13 and 14, which in cooperation function to take out the note separated from the remaining the notes by the suction head, can be replaced by a belt conveyor, and the note take-out roller 12 is not necessarily restricted to a cylindrical form but may be constructed as shown in FIGS. 10A and 10B.

Although the notes have been stored in the note storing section in a manner such that each of the notes rests on its longitudinal edge, and the notes are taken out of the note storing section upwardly starting from the foremost of the notes, it is of course possible to construct to the note take-out mechanism so that the notes are taken-out downwardly. Otherwise, the notes may be stacked up in the note storing section, and they may be taken out laterally starting from the uppermost sheet.

As a further modification, the direction of delivering the notes may be made vertical, instead of horizontal, so that the leading edge of the notes may be aligned in vertical fashion. In such a modification, however, it is necessary to start the taking-out with the notes of smaller width. It is also apparent that the present invention may be applied to the case where sheet form material other than the bank notes is to be dispensed according to a predetermined direction of classification.

D. Advantageous Features

According to the present invention, a note take-out device is provided in a stationary manner for each space in the note storing section at the delivery end thereof, so that there is no possibility of causing misalignment between the notes in the space and the note take-out device specifically provided for the space, and a reliable note taking-out operation can be thereby assured.

Furthermore, since a single note receiving device is provided commonly for the plurality of spaces of the note storing section so that the note receiving device can be moved to any of the positions aligned with the spaces for temporarily receiving the notes taken out from the note storing section, the notes of various denominations can be delivered simultaneously through the note conveying device and the note delivering port to the outside of the note dispensing apparatus according to the present invention.

Because of the fact that the positional requirement between the note receiving device and the note taking-out provided for each space of the note storing section in this invention is not as strict as that between such space and the movable note take-out device in the conventional apparatus, in other words, because the reception of notes taken out one by one from the note storing section into the note receiving device is much easier than the taking-out operation of the notes, itself, positive and reliable operation of the note dispensing apparatus as well as long operational life of the apparatus can be obtained.

In addition, the note receiving device of this invention includes a stop member, the position of which is adjusted relative to the rotatable support member, so that the leading edges of the notes are aligned or dressed by the stop member in accordance with the width of the notes of differing denomination, and the trailing edges of the notes are thereby supported by the rotatable supporting member. Thus, there is no possibility of the advance of the subsequent notes being hampered by the notes previously received in the note receiving device, or of the subsequent notes being received in an erroneous manner or in a folded state, regardless of notes of different demonimations being successively sent into the note receiving device.

Since the notes taken out of the note storing section are first sucked by the suction head at the upper half part of the notes, and the suction head has been made swingable around the lower corner, of the sucking surface, the upper half of the note thus sucked onto the sucking surface is bent along the sharp lower corner of the surface and brought into contact with the driven rollers 13 with the vacuum released at this instant. When the leading edges of the raised portions of rollers 12*a* abut against the note, the note is displaced upwards to be caught between the note feeding driving roller and driven roller without the accompaniment of any displacement due to friction of the succeeding notes, whereby the possibility of the succeeding note being taken out simultaneously with the foremost note can be eliminated.

Furthermore, since the position of the lower corner of the sucking surface is held unchanged, no slip is caused, while the suction head swings therearound, between the sucking surface and the note thus sucked, this feature further eliminating the possibliity of the vacuum being reduced by the intrusion of air. Thus, the suction head can hold the note positively and securely until the note is brought into contact with the driven roller of the note-feeding pair of rollers. At this instant, the vacuum is released, and the note is positively caught between the pair of note feeding rollers, this feature making it possible to increase the speed of taking out notes from the note storing section.

According to the present invention, the notes thus taken out of the note storing section into the note receiving section can be delivered therefrom through the note conveying and delivering devices to the note delivering port provided at the note charging side of the note dispensing apparatus, whereby not only can the operation of the note dispensing apparatus be facilitated, but also the installation thereof can be greatly simplified.

We claim:

1. A sheet dispensing apparatus comprising a plurality of sheet storing spaced for containing respectively therein stacked sheets of different denominations, a sheet dispensing section having sheet dispensing means for dispensing sheets of a predetermined and designated denomination taken out of said sheet storing space, inlet means in each of said sheet storing spaces for charging sheets of the respective denominations thereinto and means for urging the sheets charged into said space further into said sheet storing space thereby to position the foremost sheet at a position for being easily removed from the space at the end thereof remote from the end having said inlet means, both said inlet means and said sheet dispensing section being provided at the same side of the apparatus, sheet removal means in each of said sheet storing spaces and comprising a sheet removal device provided at a position confronting the foremost sheet in the sheet storing space, movable sheet receiving means movable past the ends of said sheet storing spaces having said removal means therein and including means for moving said sheet receiving means selectively to a position confronting a sheet removal device corresponding to a designated denomination and for stopping said sheet receiving means of a time sufficient for receiving and temporarily storing thereon a plurality of sheets taken successively out of the sheet storing space by the sheet removal device, said sheet receiving means further having a transferring device for simultaneously transferring all said temporarily stored sheets to said sheet dispensing means when a designated number of sheets of each denomination have been stored, and said sheet dispensing means comprises a sheet conveying device which is in a watch-and wait attitude at the transferring end of said transferring device for receiving thereon the sheets transferred by said transferring device and conveying the thus received sheets to the sheet dispensing section.

2. A sheet dispensing apparatus as claimed in claim 1, in which said sheet receiving means comprise a rotatable supporting member rotatable in a direction for receiving the sheets thereon and supporting the trailing edges of the sheets, movable stop means at a position spaced from the rotatable supporting member a distance for aligning the leading edges of the sheets supplied from said rotatable supporting member and for stopping the supply of the sheets when a designated number of sheets have been received on the sheet receiving means, means for urging the sheets toward said stop member, and cam means coupled to said stop member for automatically regulating the position of said stop member in accordance with the width of the sheet received in the sheet receiving means.

* * * * *